United States Patent [19]

Hughes

[11] Patent Number: 4,514,181

[45] Date of Patent: Apr. 30, 1985

[54] APPARATUS FOR FORMING A FLIP TOP CARTON

[75] Inventor: Charles C. Hughes, Villa Hills, Ky.

[73] Assignee: R. A. Jones & Co. Inc., Covington, Ky.

[21] Appl. No.: 532,455

[22] Filed: Sep. 15, 1983

[51] Int. Cl.[3] ..... B31B 1/62

[52] U.S. Cl. ..... 493/131; 493/142; 493/144; 493/166; 493/178; 493/183; 206/621; 206/624; 229/37 E

[58] Field of Search ..... 493/128, 130, 131, 132, 493/139, 141, 142, 144, 163, 166, 172, 178, 179, 183; 53/374, 381 R; 229/37 E; 206/621, 624

[56] References Cited

U.S. PATENT DOCUMENTS

| | | | |
|---|---|---|---|
| 3,407,712 | 10/1968 | Scully | 493/141 |
| 3,587,411 | 6/1971 | Theys et al. | 493/142 |
| 3,942,712 | 3/1976 | Bundy et al. | 206/624 |
| 3,999,469 | 12/1976 | Nilsson | 493/183 |
| 4,131,058 | 12/1978 | Graham | 493/183 |

*Primary Examiner*—W. D. Bray
*Assistant Examiner*—Jorji M. Griffin
*Attorney, Agent, or Firm*—Wood, Herron & Evans

[57] ABSTRACT

Apparatus for forming a flip top carton wherein the top of the carton has a front flap and side flaps, each having a lower section folded upon the body of the carton and a middle section folded on the lower section. The apparatus has a former associated with a conventional cartoning machine which projects into an erected tubular carton spreading the front and side flaps while inwardly pressing the top portion of the carton to fold the lower section on the top portion of the carton and the middle section on the lower section to form a collar. The apparatus further includes a glue station for applying glue to the internal surfaces of the overlying middle and lower sections. The apparatus further includes compression sections for pressing the lower and middle sections to which glue has been applied together to complete the formation of the collar.

9 Claims, 15 Drawing Figures

APPARATUS FOR FORMING A FLIP TOP CARTON

This invention relates to apparatus for forming a flip top carton in which a three-ply collar is formed around front and side walls of the carton. The flip top collar can be torn along score lines at the front and sides of the carton and thereafter pivoted along a hinge line on the back wall. The flip top is adapted to be closed by pivoting it back to its original position whereupon it telescopes over the top portion of the carton.

The apparatus principally used in forming the flip top carton has been a double package-making machine. In the normal operation of such a machine, a flat carton blank is folded along one edge to form the collar. That blank is thereafter wrapped around a mandrel and glued to form a tubular carton having the collar at the top end. A bag inside the tubular carton is subsequently filled and sealed to contain the product.

There are a number of disadvantages to the use of a double package-making machine as contrasted to a conventional cartoner. Principally, it is slow, running at about 50 cartons per minute, as contrasted to a conventional continuous motion cartoner which, for products of the type run on a double package-making machine, will operate at about 160 cartons per minute.

An objective of the present invention has been to provide apparatus permitting the running of flip top cartons of the type described on a continuous motion cartoner. A continuous motion cartoner of the type contemplated herein includes apparatus for erecting cartons and feeding them in an erected tubular condition into transport lugs of a transport conveyor. A product bucket conveyor having product buckets aligned with transport lugs runs alongside the transport conveyor. A barrel loader having cam-operated pusher heads pushes product from the product buckets into the erected cartons carried between the transport lugs so as to fill the cartons. Thereafter, gluing and sealing apparatus close the end flaps of the carton.

It has been possible with existing technology to run the flip top carton on a continuous motion cartoner. Two alternatives for forming the flip top carton are known. The first utilizes a complex mechanism for forming the carton with a completed flip top collar immediately ahead of the cartoning apparatus. The second involves apparatus at a carton converter where the cartons would be formed and shipped to the plant where the cartoning apparatus is run. Both of the foregoing approaches are costly and the cartons are difficult to run. For example, in loading the cartons into a magazine, the three-ply collar at one end of the carton causes the magazine to fill unevenly and, hence, only a few cartons can be loaded into a magazine at a time.

Another objective of the present invention has been to provide apparatus by which a tubular, flat folded carton can be erected as a tube in a conventional cartoner and, while carried between transport lugs of the transport conveyor, mechanism is provided to form and glue the three-ply collar structure of the carton.

This objective of the invention is attained by providing, in association with the transport conveyor of the cartoner, a former which, operating in a manner similar to a barrel loader, is moved into the open end of the carton and folds the lower sections upon the top portion of the carton and the middle sections upon the lower sections, thereby forming the three-ply collar. More specifically, the former has surfaces which engage the front flap and side flaps to flare them outwardly. Substantially simultaneously, the pressure of the former on the front and side flaps causes the top portion of the carton to tend to collapse inwardly so that the outwardly-flared side and front flaps can be driven over the top portion of the carton with the lower and middle sections folding as described to form the collar.

Upstream of the former mechanism, it is preferred to provide a deflector which engages the front flap to depress it inwardly so that as the former applies force to the end of the carton, the deflector prevents an outward bulging of the top portion of the carton.

When the top portion of the cartons initially folds to form the collar, the inner surfaces of the lower sections and middle sections have an open V configuration into which glue can be deposited. The invention contemplates the provision of gluing apparatus with glue heads adapted to apply glue to those inner surfaces.

Downstream of the gluing apparatus, a compression mechanism is provided to press the surfaces of the lower and middle sections of the front flap together while the glue sets. This compression section employs a moving pressure pad which slides into the interior of the carton. Immediately above the pressure pad is a roller which rolls against the outer surface of the middle section and compresses it as well as the plies below it against the pressure pad while the glue sets.

Downstream of the foregoing compression mechanism is another compression station for pressing glued side flaps inwardly until the glue deposited there sets.

The resultant carton with the collar thus formed will have conventional dust flaps, a glue flap and a major top flap which is folded by conventional apparatus onto the dust and glue flaps to seal a collar end of the carton. The opposed end of the carton is closed and sealed by conventional mechanism.

It can be seen from the foregoing that the apparatus has the advantage of using conventional high speed continuous cartoning apparatus wherein the flat folded cartons are erected and placed into transport lugs before the collar is formed. By forming the collar on the cartoning machine, none of the disadvantages of requiring special complex machinery, coupled with the difficulties of handling in a magazine associated with the erecting apparatus, are encountered.

The several objectives and features of the present invention will become more readily apparent from the following detailed description taken in conjunction with the accompanying drawings in which.

Figure 1:
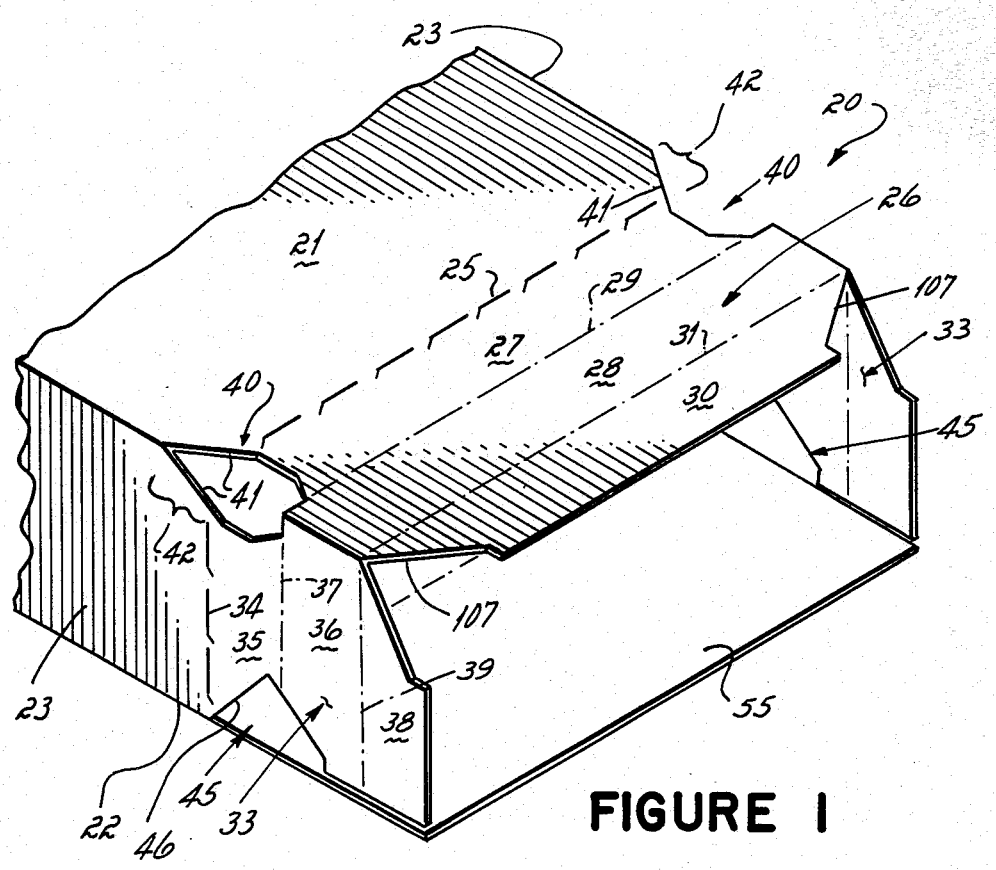
FIG. 1 is a perspective view of the top end of a carton to be run on the apparatus of the present invention.

The carton with which the present invention is used is indicated at 20 in FIG. 1. It has a front wall 21, a back wall 22 and side walls 23. Connected to the front wall along a tearable score line 25 is a front flap 26. The front flap has a lower section 27, a middle section 28 hinged to the lower section along a crease or score 29 and a glue flap 30 hinged to the middle section along a crease 31.

Each side wall has a side flap 33 hinged along a tearable score 34 similar to the score 25. The side flap has a lower section 35, a middle section 36 hinged to the lower section along a crease or score 37 and a dust flap 38 hinged to the middle section along a crease 39.

The upper corners of the carton have notches 40 cut therefrom. The lower portion of the notches are defined by V-shaped edges 41. These notches 40, and particularly the lower portion defined by the V-shaped edges 41, permit the top portion of the carton, indicated generally by the brackets 42, to collapse inwardly so as to present a generally inward taper to the upper portion which permits the collar formed by the lower section 27 and the middle section 28 to slide over it.

Notches 45 are formed in the rearward edges of the side flaps 33. These notches assist in permitting the former, to be described, to flare the side flap outwardly and provide edges 46 engageable by the former to facilitate the thrust of the side flaps over the inwardly-collapsed top portion of the carton.

Figure 2:
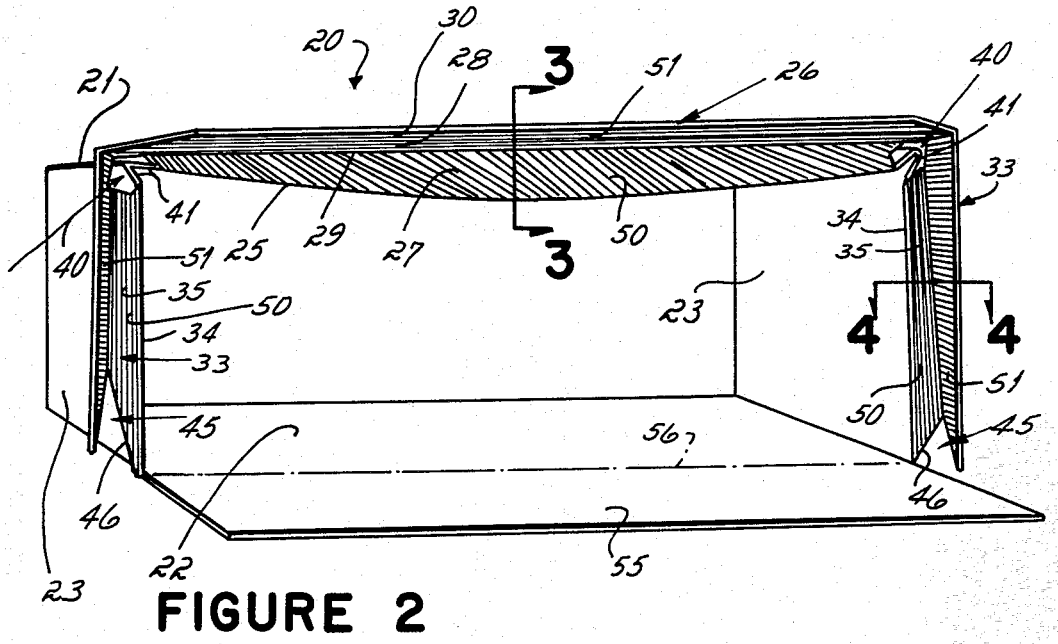
FIG. 2 is a perspective view of the top end of the carton with the collar formed prior to gluing.

After initial formation of the collar for the carton, the collar in a perspective view of the end appears as illustrated in FIG. 2. The lower sections 27 and 35 are folded upon the upper portion of the carton 42. The middle sections 28 and 36 are folded upon the lower sections 27 and 35, respectively. In this attitude, the lower and middle sections present internal surfaces 50 and 51 which face each other and have a generally open V configuration. Glue is applied to these surfaces which are thereafter squeezed together until the glue sets sufficiently to cause the surfaces to adhere, thus completing the formation of the collar.

Figure 5:
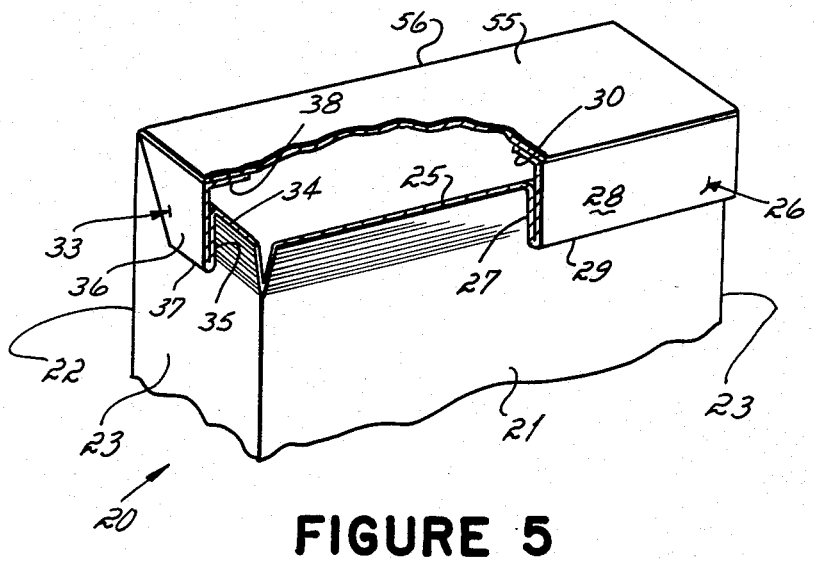
FIG. 5 is a perspective view, partly in section, showing the completed top of the flip top carton.

A major top flap 55 is hinged along a crease 56 to the back wall 22. When the carton is filled with product, the dust flaps 38 are folded across the top of the carton as well as the glue flap 30. Glue is applied to these flaps and the major top flap 55 is folded across the top to complete the top of the carton. In its completed form, the top of the carton appears as illustrated in FIG. 5. The score lines 25 and 34 are tearable by the consumer who simply presses against the front wall 21 and pulls up on the collar. The score lines 25 and 34 permit the collar easily to be separated from the top portion of the carton and swung back on the crease 56. After some product is removed, the collar (flip top) can be returned to the position shown in FIG. 5.

Figure 3:
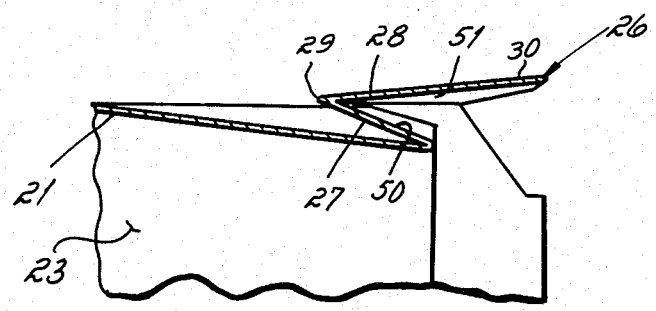
FIG. 3 is a cross-sectional view taken along lines 3—3 of FIG. 2.
Figure 4:
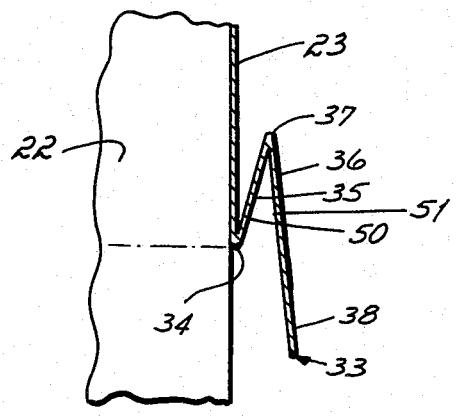
FIG. 4 is a cross-sectional view taken along lines 4—4 of FIG. 2.
Figure 6:
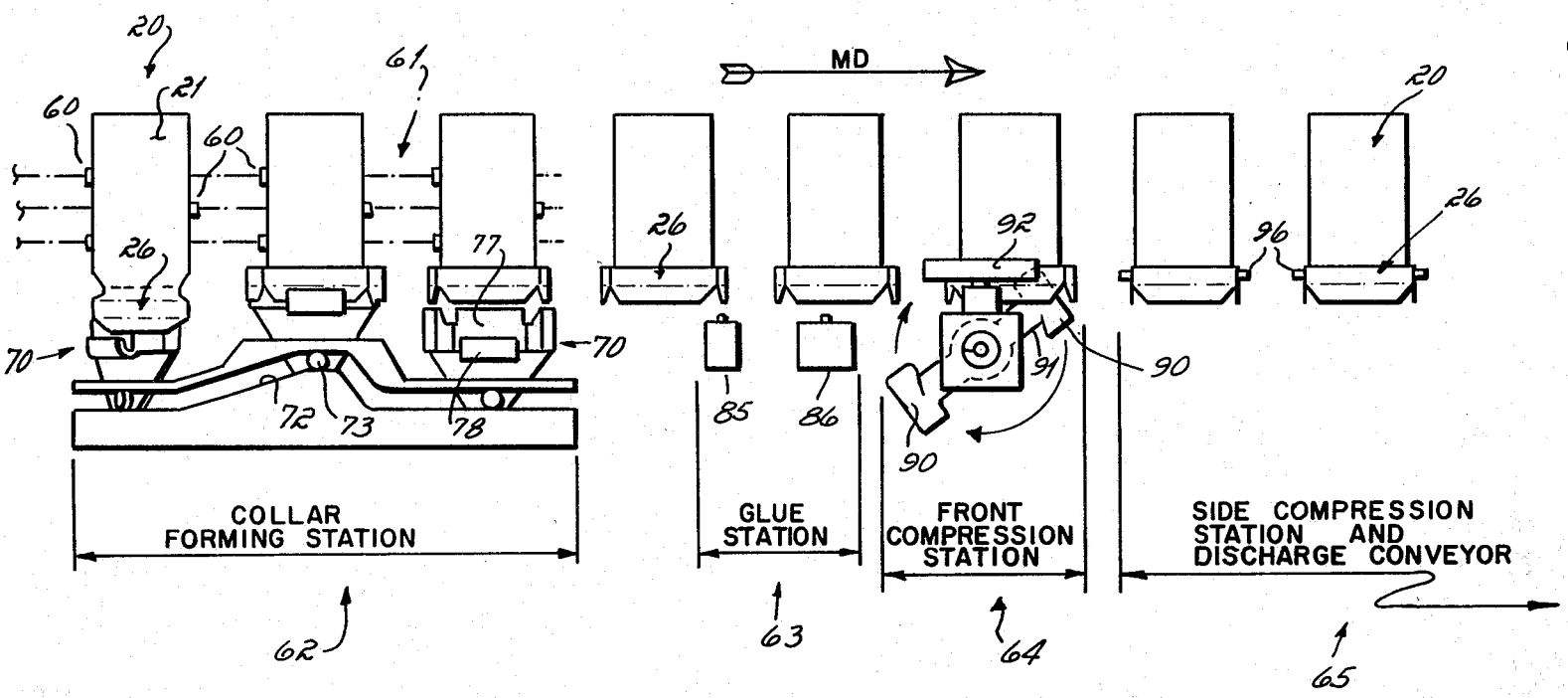
FIG. 6 is a diagrammatic top plan view of the apparatus.

The apparatus for forming the carton is diagrammatically illustrated in FIG. 6. The cartons are erected and conveyed between transport lugs 60 on a transport conveyor 61 formed of endless chains. See U.S. application Ser. No. 441,377, filed Nov. 12, 1982, for a more complete description of cartoning apparatus with which the invention can be used. Between the erecting station, not shown here, and the barrel loading station at which product is inserted into the carton, likewise not shown here, the forming apparatus of the present invention is located. With the cartons being transported left to right as indicated by the arrow in FIG. 6, the collar-forming station is shown at 62 at the upstream end of the cartoner apparatus. There, the collar is formed and will appear as shown in FIGS. 2–4. Downstream of the collar-forming station is a glue station 63 at which a spot of glue is applied to the inner surfaces of the side flaps and a line of glue is applied to the inner surfaces of the front flap.

Downstream of the glue station is a compression station 64 where the inner surfaces 50, 51 of the front flap are pressed together until the glue sets sufficiently for the surfaces to adhere.

Downstream of the front compression station is a side compression station 65 at which the side flaps are pressed inwardly sufficiently for the surfaces 50, 51 to adhere.

Referring to the collar-forming station 62, a plurality of formers 70 are carried on endless chains (not shown) carrying the formers generally parallel to the transport conveyor 61. The formers are mounted for inward and outward sliding with respect to the conveyors in much the same manner as a conventional barrel loader. A cam slot 72 cooperates with followers 73 on the former slides to cause the slides to move in and out or toward and away from the cartons 10 carried by the transport lugs. In moving in and out, the formers engage the front and side flaps to thrust them over the top portion of the carton to form the collar in a manner to be described in more detail below.

Figure 7:
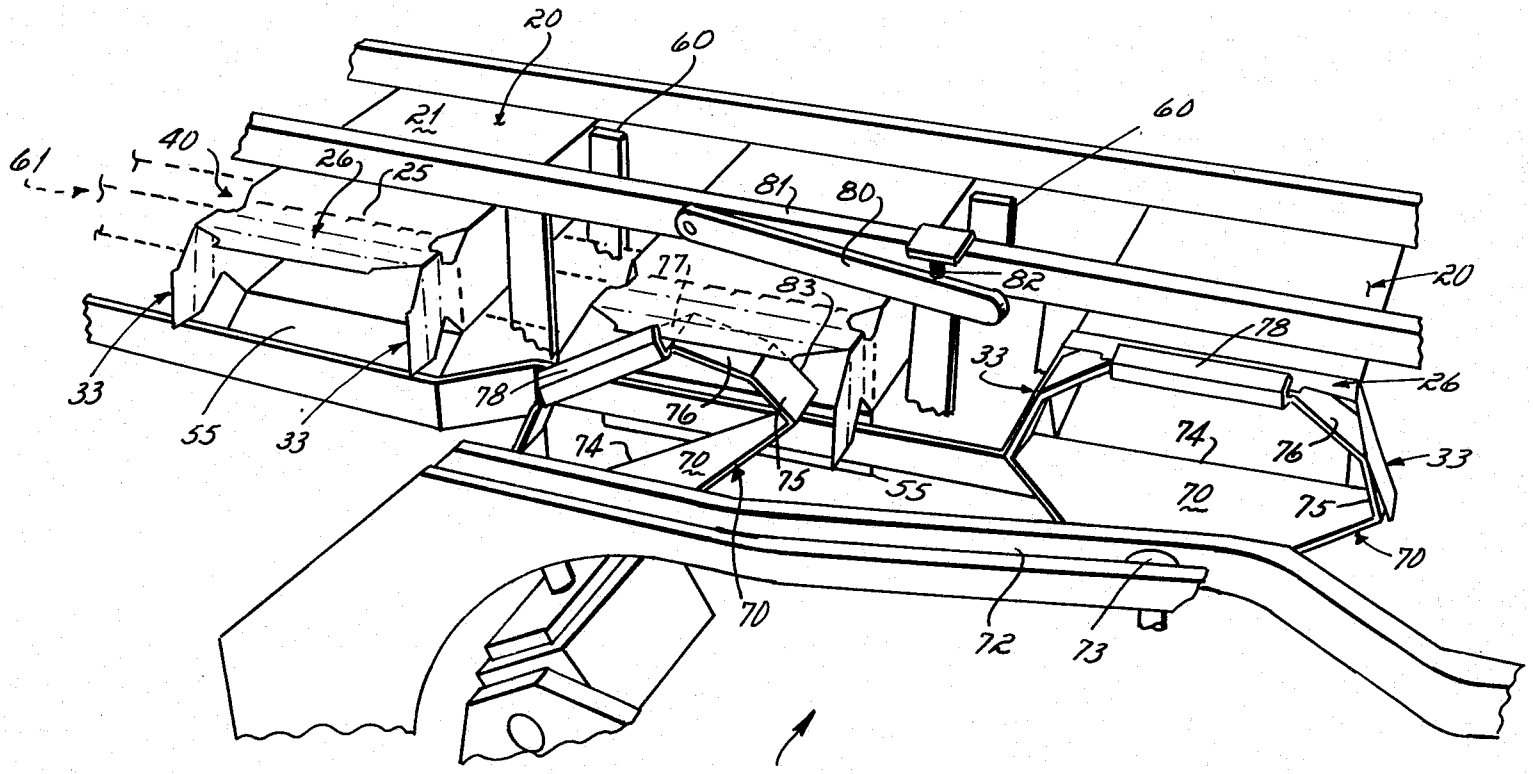
FIGS. 7, 8 and 9 are perspective views of the forming mechanism operating in conjunction with the cartons.
Figure 8:
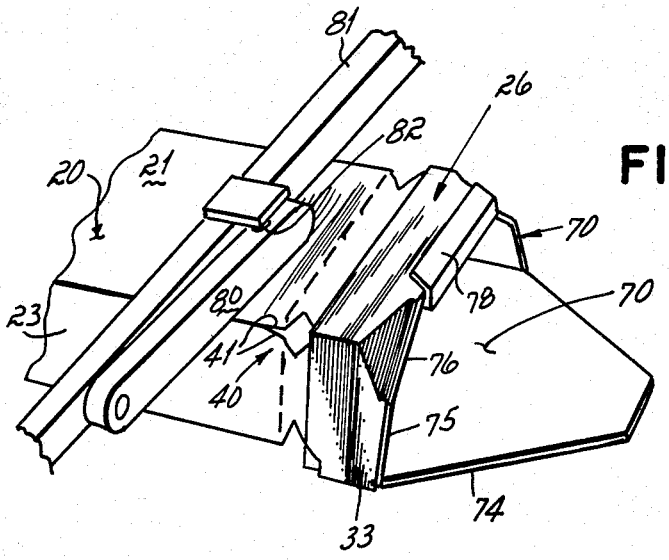
Figure 9:
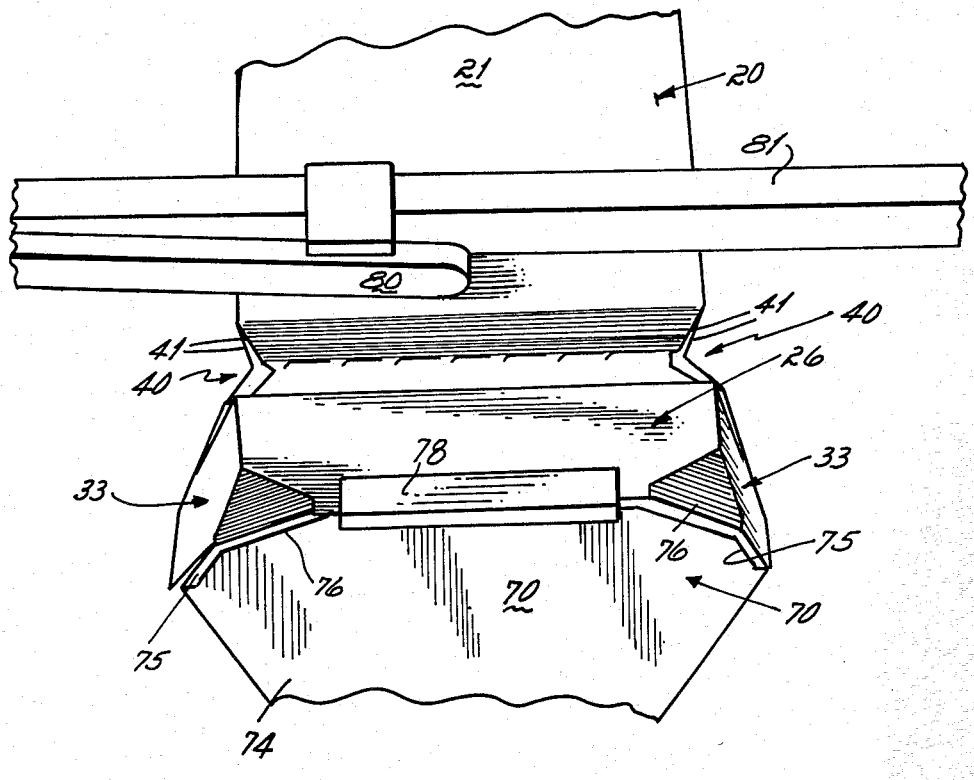
Figure 10:
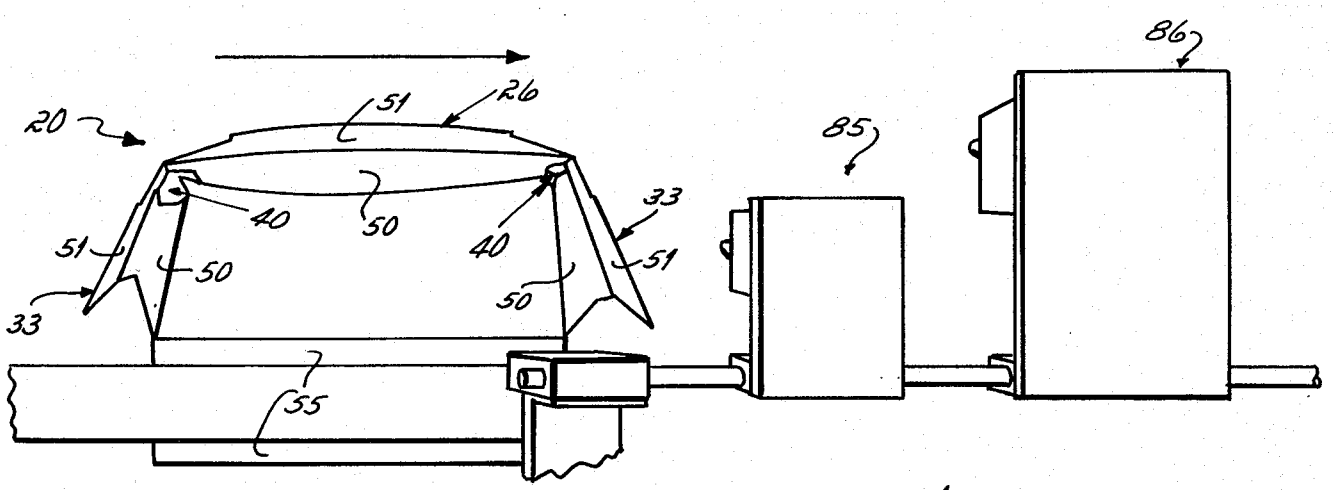
FIG. 10 is a side elevational view of the apparatus between the former and the glue station showing a carton about to pass through the glue station.

Turning to FIGS. 7, 8 and 9, the former 70 in cross section is a closed, geometrical figure having a base 74, lower side sections 75 which are angled inwardly from the base, upper side sections 76 which are angled inwardly from the lower sections, and a top section 77 interconnecting the upper side sections 76. A generally arcuate flange 78 projects upwardly from the top section 77. The top section 77 and lower side sections 75 have leading surfaces, that is, surfaces adjacent the transport conveyor which are tapered inwardly to facilitate entry into the open end of the carton. The outer dimensions of the outer surfaces of the former 70 are substantially greater than the corresponding dimensions of the carton so that when the former is thrust into the open end of the carton, it will tend to flare the front flap 26 and side flaps 33 outwardly.

At the upstream end of the collar-forming station 62, a deflector blade 80 is pivotally mounted to a top rail 81 of the cartoner. The deflector blade 80 is angled downwardly and urged downwardly by spring 82 into the path of the front surface of the carton so as to engage the carton approximately along the score line 25 to deflect it inwardly. Thus, when the former enters the open end of the carton, flaring the front flap and side flaps outwardly, the action of the blade 80 will prevent the carton from bulging outwardly under the force of the former. As best shown in FIG. 7, the former conveyor is timed to the transport conveyor to cause each former 70 to enter the open end of the carton before the cam slot causes the former to move inwardly. It can be seen in FIG. 8 that in this position the front flap 26 and side flaps 33 are flared outwardly and that the blade 80 is depressing the front wall 21 inwardly to prevent bulging. The combined action of a blade 80 and former 70 will also tend to force the upper ends of the side walls 23 inwardly along the score lines 34.

As each former 70 is thereafter thrust inwardly, the lower sections 27 and 35, respectively, will fold over the top portion of the carton. The force applied to these lower sections by the former will drive the top portion of the carton further inwardly, the inward movement being permitted by the notch 40, with the V-shaped edges 41 substantially closing upon one another. The lower side sections of the former present leading edges 83 which engage the edge 46 of the notch 45 of each lower section 35 to drive each lower section of the side flap over upon the upper portion of the carton.

The interaction of the flared former walls with the resilience or fight of the board forming the carton causes the open V sections formed by the inner surfaces 50, 51 of the lower and middle sections after the former has withdrawn. When the former has withdrawn, the carton is ready for an application of glue at the glue station 63.

The arcuate flange 78 on the top wall 77 of the former is not believed to be essential. However, it does assist in driving the front flap over the front wall of the carton and keeping it from bulging outwardly.

The glue station has two glue guns 85 and 86. The gun 85 is programmed to squirt a spot of glue upon the internal surface 50 of each side flap. The glue gun 86 is programmed to squirt a line of glue on the surface 50 of the front flap 26.

Figure 11:
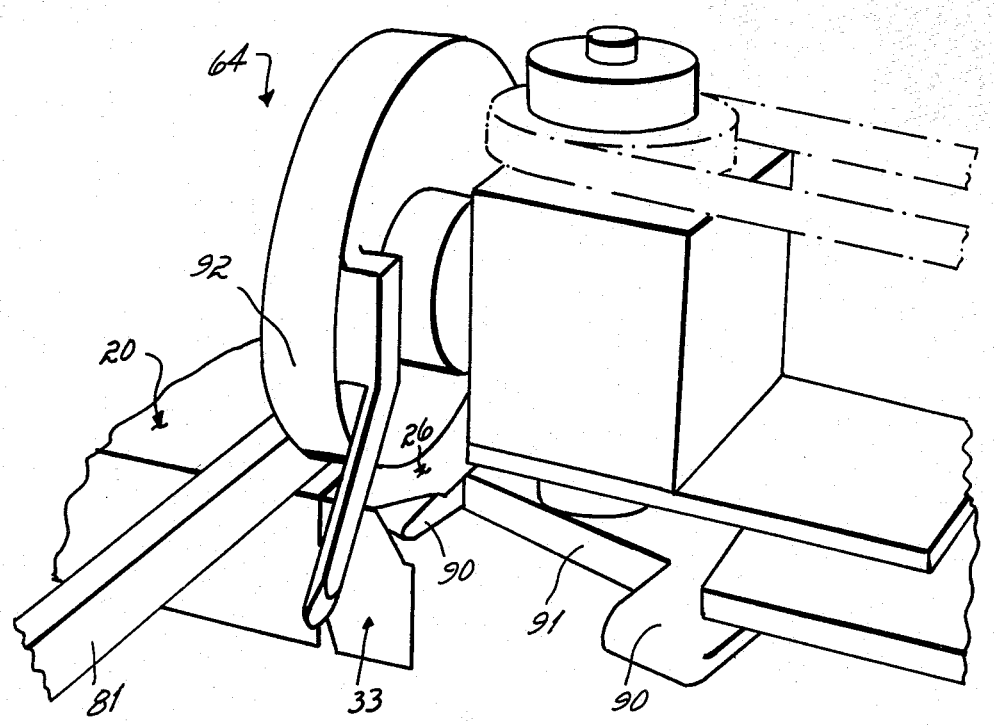
FIGS. 11 and 12 are perspective views of the compression mechanism in which the glue for the front portion of the collar is set.
Figure 12:
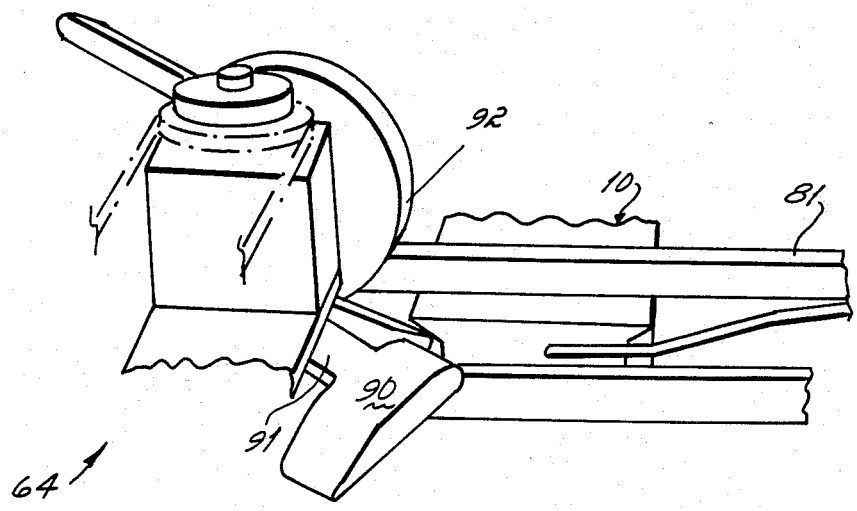

After glue is applied, the carton advances to the front compression station 64. The front compression station has a pair of compression pads 90 mounted on a rotating arm 91 timed to the cartoning machine. Overlying the path of the compression pads is a roller 92. As illustrated in FIG. 6 as well as FIG. 11, the compression pad enters the interior of the carton immediately below the top portion of the carton. The roller engages the exposed middle section 28 of the carton and presses it as well as the lower section and front portion together against the compression pad as the compression pad swings through the interior of the carton. This action holds the surfaces 50, 51 together for a sufficient length of time to cause them to adhere.

Figure 13:
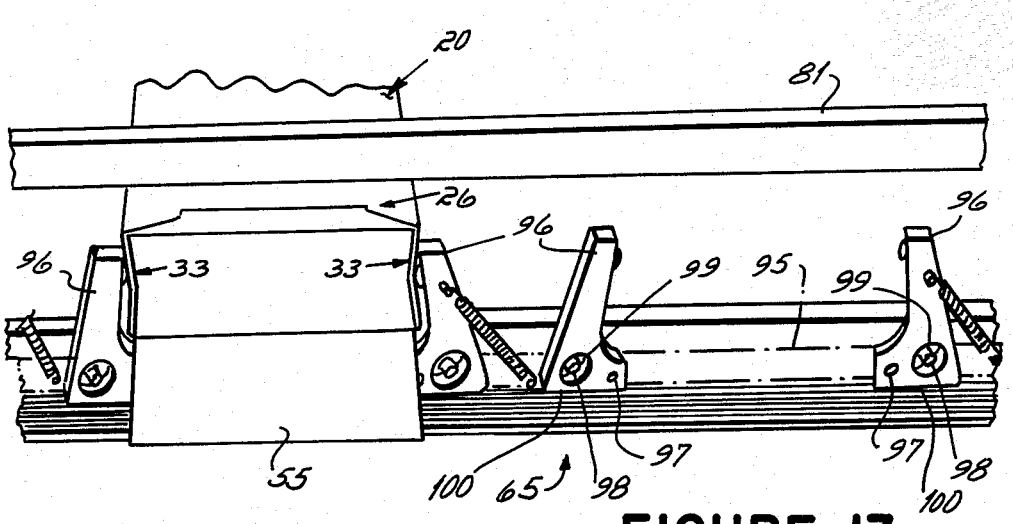
FIG. 13 is a perspective view of the section for compressing the side walls of a collar.

The carton advances beyond the front compression station into the side compression station 65 illustrated in FIG. 13. The side compression station has an endless chain 95 which carries pairs of opposed lugs 96. The lugs are pivoted at 97 to the chains and are permitted limited pivotal movement by a pin 98 passing through a large bore 99 in the lug. The lower surface 100 of each lug is engageable by a cam surface which permits the lugs to open up as they swing around the upstream end of the chain so as to permit them to capture a carton. As they move to the upper horizontal portion of the chain, they are cammed closed and, as illustrated in FIG. 13, press inwardly on the sides of the upper portion of the carton to force the surfaces 50, 51 of the end flaps together to cause them to adhere to each other.

Thus, the collar is formed and securely glued. Thereafter, the dust flaps 38, glue flap 30 and major top flap 55 are folded across the top of the carton after the product has been inserted and sealed in a conventional manner.

In the operation of the apparatus, a carton 10 is erected in a conventional manner and disposed between transport lugs 60. As the carton approaches the collar-forming station 62, the upper surface of the top portion of the carton is depressed by the blade 80. Substantially simultaneously with the action of the blade 80, the former 70 is guided into the top portion of the carton as the former comes up from the lower run of the conveyor carrying it. After it has swung into position within the top portion of the carton, the former is cammed forward and causes the lower sections 27 and 35 to fold upon the top portion 42 of the carton and the middle sections 28 and 36 to fold upon the lower sections 27 and 35. Since the dimensions of the former are greater than the inside dimensions of the carton, the sections 27 and 28, as well as the comparable side sections, are flared outwardly and over the top portion of the carton as the top portion is simultaneously caused to bend inwardly.

In this stage of the formation, the carton appears as illustrated in FIG. 2 with V-shaped openings formed between the lower sections and middle sections of the top and side flaps, respectively. At the glue station 63, glue is directed into those V areas. At the front compression station 64, the sections 27 and 28 are pressed together by the sandwiching action of the compression pad 90 and roller 92.

Finally, the side sections 35 and 36 are pressed together by the lugs 96 to cause the glue between them to adhere. Thus, the collar is formed and the carton is ready for filling at the barrel loader and thereafter closing on conventional apparatus.

Figure 14:
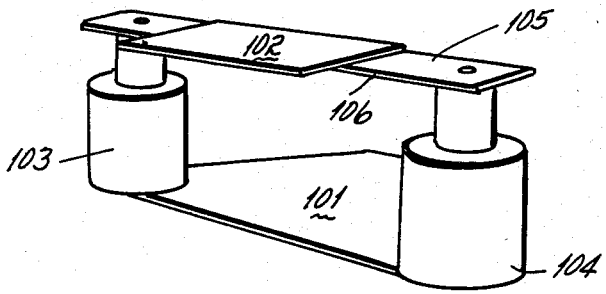
FIGS. 14 and 15 are perspective views of early modifications of the former.
Figure 15:
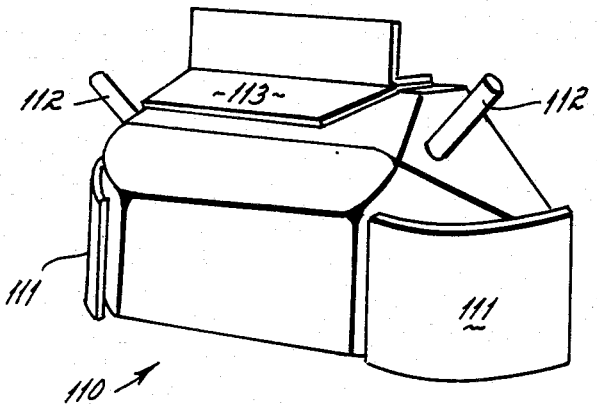

Alternative forms of the former 70 are illustrated in FIGS. 14 and 15.

The former of FIG. 14 indicated at 100 has a base 101 and an opposed upper section 102. Rollers 103 and 104 are adapted to engage the side flaps of the carton. At the outermost extremities of the rollers, the dimension is substantially greater than that of the interior of the carton. The top section has a crossbar 105 having forward edge portions 106 which engage corners 107 of the carton itself (FIG. 1). The engagement of those corners as the former moves into the carton drive the side and front flaps over the top portion of the carton. The rollers assist in flaring the side flaps outwardly so that the action in forming the collar over the top portion of the carton is similar to that of the former 70.

Another former, 110, is illustrated in FIG. 15. In that former, arcuate surfaces 111 perform the functions of the rollers 103, 104 of former in FIG. 14. The former also has angulated pegs 112 which engage the notches 107, thus performing the function of the edges 106 of the former 100. As angulated flange 113 performs the function of sliding under the front middle flap 28 to flare it outwardly as the arcuate surfaces 111 flare the side flaps outwardly so that the collar can be forced over the top portion of the carton in a manner similar to that of the former 70.

Having described my invention, I claim:

1. Apparatus for forming the top portion of a flip top carton having interconnected front and side flaps and a separate rear flap, said front and side flaps being transversely creased or scored to present a lower section foldable on the top portion of the carton, a middle section foldable on said lower section, and a glue flap, said apparatus comprising, a transport conveyor for carrying a plurality of cartons erected to a tubular form, and aligned so that the longitudinal axis of each carton is transverse to the conveying direction, a forming conveyor parallel to said transport conveyor for carrying a plurality of formers each engageable with the top of a respective carton, cam means associated with said forming conveyor for moving said formers toward and away from said cartons, each said former having surfaces engageable with said middle and lower sections of a carton to fold said lower sections upon the top portion of said carton and to fold said middle section on said lower section.

2. Apparatus as in claim 1 further comprising a top deflector located adjacent the upstream end of said former conveyor for depressing the front flap of each said carton along the crease between the top portion of said carton and said lower section to prevent outwardly bulging of said carton when engaged by said former.

3. Apparatus as in claim 1 in which the longitudinal and vertical dimensions of said former are greater than the longitudinal and vertical dimensions of said carton opening whereby as said former is inserted into the top portion of said carton, said former spreads said front and side flaps outwardly to facilitate the folding of said top flap sections.

4. Apparatus as in claim 1 further comprising hot melt gluing apparatus located downstream of said former conveyor for squirting glue onto the internal surface of one of said lower and middle sections to permit those surfaces to be adhesively secured.

5. Apparatus as in claim 4 further comprising, compression means located downstream of said gluing apparatus to squeeze the internal surfaces of said lower and middle flaps together.

6. Apparatus as in claim 5 in which said compression means comprises, a rotating compression pad, means for rotating said pad into said carton opening to temporarily underlie the top portion of said carton as it is conveyed past said compression means, and a roller rotatably mounted above said compression pad to engage the outer surface of said middle section to squeeze it against said lower section and top portion of said carton.

7. Apparatus as in claim 4 further comprising, side compression means located downstream of said gluing apparatus, said side compression means engaging the outer surfaces of said middle sections of said side flaps and pressing them together while the glue between said middle sections and lower sections sets.

8. Apparatus as in claim 7 in which said side compression means comprises, a pair of lugs associated with each carton, endless conveyor means carrying said lugs alongside said transport conveyor, and cam means swinging said lugs toward each other as a carton passes between them.

9. Apparatus as in claim 1 in which said former comprises, an element which in cross section is a closed geometric figure having a base, lower side sections angled inwardly, upper side sections angled from said lower side sections and a top member, said lower sections flaring said side flap middle sections outwardly and said top member flaring said fron flap middle section outwardly while the top portion of said carton is forced inwardly by said lower sections so that upon continued inward movement of said former said lower and middle sections fold upon said top portion and lower section, respectively, to form a collar around the top of said carton.

* * * * *